US008763976B1

(12) United States Patent
Jachim

(10) Patent No.: US 8,763,976 B1
(45) Date of Patent: Jul. 1, 2014

(54) MOUNTING ACCESSORY FOR PERSONAL ELECTRONICS

(75) Inventor: Anton Jachim, St. Paul, MN (US)

(73) Assignee: Arctic, LLC, St. Paul, MN (US)

( * ) Notice: Subject to any disclaimer, the term of this patent is extended or adjusted under 35 U.S.C. 154(b) by 8 days.

(21) Appl. No.: 13/353,201

(22) Filed: Jan. 18, 2012

(51) Int. Cl.
*B41J 11/02* (2006.01)

(52) U.S. Cl.
USPC ..... 248/442.2; 248/462; 248/918; 108/43; 296/1.07

(58) Field of Classification Search
USPC ..... 248/231.85, 284.1, 310, 445, 447, 453, 248/460, 462, 905, 918, 919, 921, 924, 248/442.2; 296/1.07; 108/43
See application file for complete search history.

(56) References Cited

U.S. PATENT DOCUMENTS

| | | | | |
|---|---|---|---|---|
| 3,954,297 | A * | 5/1976 | Linke et al. | 296/97.6 |
| 4,989,813 | A * | 2/1991 | Kim et al. | 248/184.1 |
| 5,937,765 | A * | 8/1999 | Stirling | 108/43 |
| 6,880,793 | B2 * | 4/2005 | Huang et al. | 248/304 |
| 7,073,449 | B2 | 7/2006 | Pipkin | |
| 7,611,117 | B1 * | 11/2009 | Lang, Jr. | 248/452 |
| 7,789,363 | B2 * | 9/2010 | Duan | 248/284.1 |
| 7,861,985 | B2 | 1/2011 | Galvin | |
| 8,066,243 | B2 * | 11/2011 | Svedman et al. | 248/304 |
| 2001/0003961 | A1 * | 6/2001 | Hodge et al. | 108/97 |
| 2004/0077308 | A1 | 4/2004 | Sanford et al. | |
| 2008/0195494 | A1 | 8/2008 | Postrel | |
| 2009/0259663 | A1 | 10/2009 | Ramani et al. | |
| 2009/0273441 | A1 | 11/2009 | Mukherjee | |
| 2010/0078536 | A1 | 4/2010 | Galvin | |
| 2010/0115634 | A1 | 5/2010 | Chung et al. | |
| 2010/0120507 | A1 | 5/2010 | Rodgers et al. | |
| 2010/0312464 | A1 | 12/2010 | Fitzgerald et al. | |
| 2011/0066658 | A1 | 3/2011 | Rhoads et al. | |
| 2011/0068227 | A1 | 3/2011 | Kneller et al. | |
| 2012/0126087 | A1 | 5/2012 | Curatolo et al. | |

* cited by examiner

*Primary Examiner* — Gwendolyn Baxter
(74) *Attorney, Agent, or Firm* — Schwegman, Lundberg & Woessner, P.A.

(57) ABSTRACT

An example includes a mount for use with an electronic device. The mount includes a base that is configured to be located between an airplane tray table and a seat when the airplane tray table is in an upright and locked position, and an electronics mount to hold the electronic device.

22 Claims, 23 Drawing Sheets

MOUNTING ACCESSORY FOR PERSONAL ELECTRONICS

BACKGROUND

People often use electronic devices, such as tablet computers, e-book readers and MP3 players, while travelling. A person may desire to have an electronic device to be located in a certain position, such as when the person is reading or watching a movie. While people are traveling, such as on an airplane, space can be at a minimum. What is needed is a convenient mount for an electronic device that can be used in various situations.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Electronic devices are being used more and more frequently. Users of electronic devices have found them to be particularly useful when the user is traveling, such as on an airplane. Accordingly, designers seek to reduce the effort needed for a user to enjoy an electronic device. For example, a mount to position and restrain an electronic device to increase the enjoyment of a user's experience with the electronic device. This document describes, among other things, a mount for an electronic device.

Figure 1:
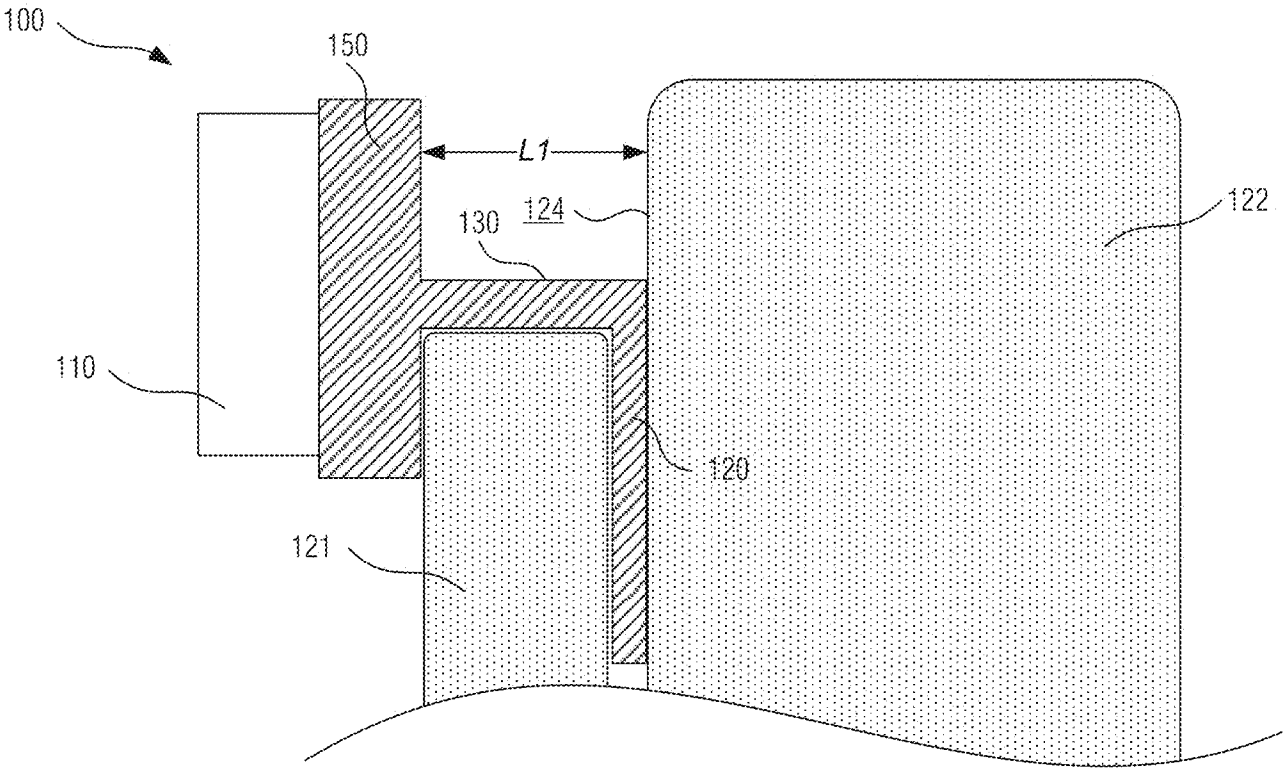
FIG. 1 shows a side view cross-section of a mount mounting an electronic device to a seat, according to an example.

FIG. 1 shows a side view cross-section of a mount 100 mounting an electronic device 110, according to an example. In an example, the mount 100 can hold an electronic device 110, for example to elevate the electronic device 110 off of a tray table and more level with a natural viewing angle, which can reduce neck-pain, among other things. An electronic device 110 can comprise a cell phone, such as a smart phone or a super phone, a tablet computer, an c-book reader, a MP3 player, or another device. Example devices are sized to be held by a user, in their hands.

The mount 100 can include a base 120. The base can be planar, such as to conform to a plane 124. The base 120 is sized and shaped to fit between an airplane tray table 121, such as a tray table in an upright position, including tray tables locked into position, and a seat including a seatback 122. In some examples, the base is sized and shaped to be disposed in a recess of an airplane seat, the recess beings size to receive a stowed tray table. The base 120 can provide support for the mount 100, for example to support an electronic device 110.

Various examples include a cantilever 130 coupled with the base 120. The cantilever can be formed to be one continuous piece with the base, such as by welding the cantilever 130 to the base 120, or injection molding the mount 100 such that the cantilever 130 and base 120 are monolithic.

In various examples, the base 120 provides support for the cantilever. Webbing, buttresses and the like can increase the rigidity of the coupling between the base and the cantilever. In various examples, the cantilever 130 extends between the base and an electronics mount 150, the cantilever having a cantilever length L1 at least as long as a thickness of tray table, to dispose the electronics mount 150 away from the airplane seat 122 when the tray table 121 is in a stowed state with the base 120 disposed between the tray table 121 and the airplane seat 122.

As used herein an electronics mount can include a snap-fit, for example to removably snap to a top and bottom, or opposing sides, of the electronic device 110. Some examples couple to only a portion of the electronic device, such as a side, or another aspects of the electronic device, including recessed fasteners disposed in the back of the electronic device, examples of which can be arranged in a standard pattern such as those agreed upon by industry trade groups. Accordingly, examples are included in which a fastener couples the electronic device 110 to the electronics mount 150. Examples of fasteners include, but are not limited to, screws, magnets, reusable adhesive, hook-and-loop and the like.

The mount 150 can be removably coupled to the electronic device 110. Accordingly, the mount 100 can be "L" shaped, and can dispose the electronic device 110 away from the airplane seat 122, and the tray table 121, at a distance desirable to a user, such as a position that decreases neck strain when viewing the electronic device, such as when watching a movie with the electronic device.

Figure 2A:
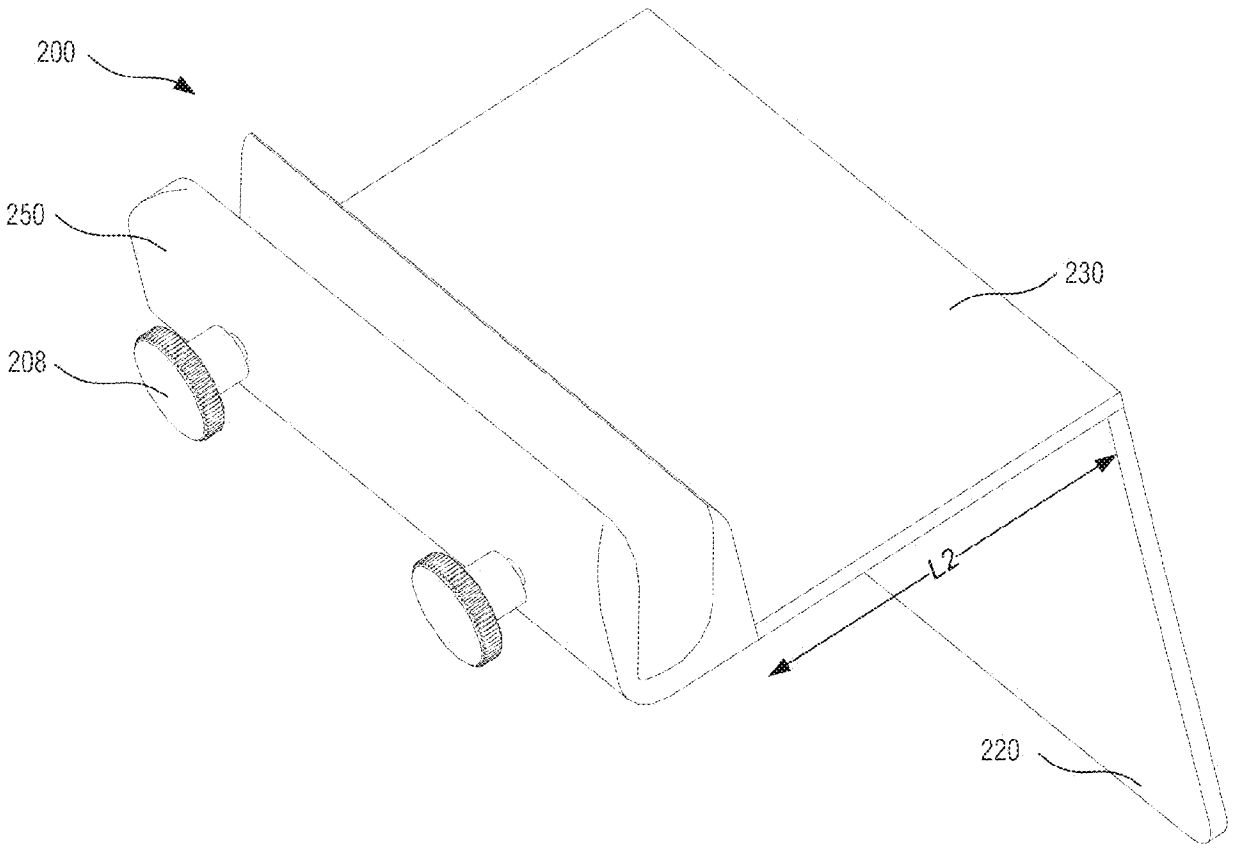
FIG. 2A shows an elevated perspective view of a mounting accessory for personal electronics, including fasteners, according to an example.
Figure 2B:
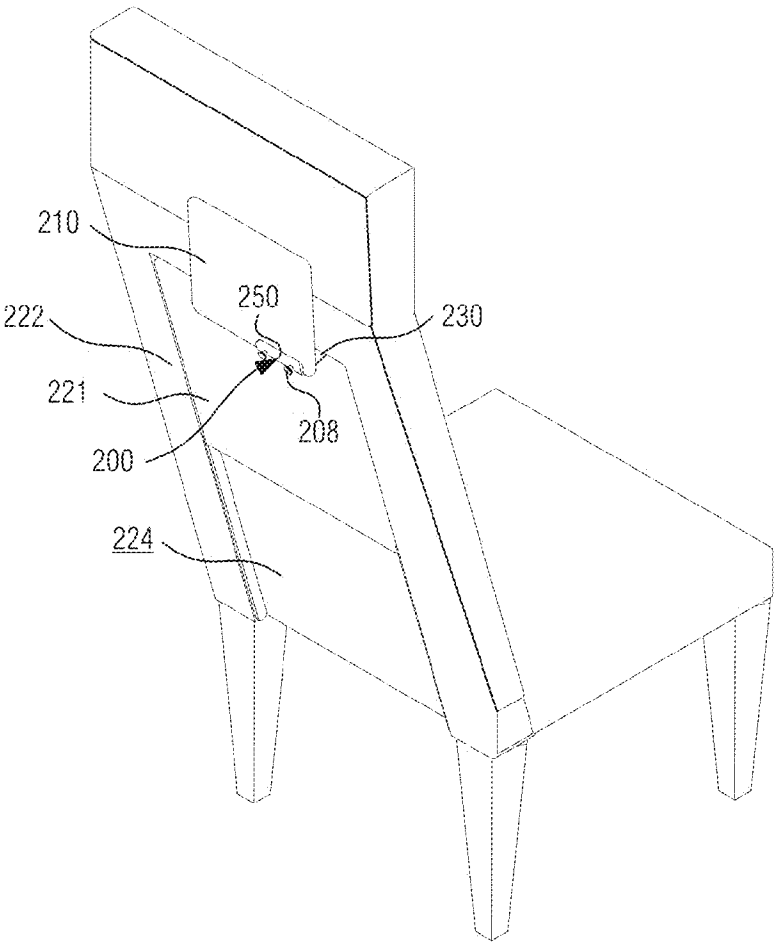
FIG. 2B shows the mounting accessory of FIG. 2A, mounted to a tray table of an airplane seat, according to an example.

FIG. 2A shows an elevated perspective view of a mounting accessory for personal electronics, including fasteners, according to an example. FIG. 2B shows the mounting accessory of FIG. 2A, mounted to a tray table of an airplane seat, according to an example. In an example, the mount 200 can hold an electronic device 210, such as to elevate the electronic device 210 off of a tray table and more level with a natural viewing angle.

The mount 200 can include a base 220. The base can be planar, for example to conform to a plane 224. The base 220 is sized and shaped to fit between an airplane tray table 221, such as a tray table in an upright position, including tray tables locked into position, and a seat including a seatback 222. The base 220 can provide support for the mount 200, such as to support an electronic device 210.

Various examples include a cantilever 230 coupled with the base 220. The cantilever can be formed to be one continuous piece with the base, such as by welding the cantilever 230 to the base 220, or injection molding the mount 200 such that the cantilever 230 and base 220 are monolithic.

In various examples, the base 220 provides support for the cantilever. In various examples, the cantilever 230 extends between the base and the electronics mount 250, the cantilever having a cantilever length L2 at least as long as a thickness of tray table, to dispose the electronics mount 250 away from the airplane seat 222 when the tray table 221 is in a stowed state with the base 220 disposed between the tray table 221 and the airplane seat 222.

The electronics mount 250 can be removably coupled to the electronic device 210. In an example, thumb screws 208 are provide to removably fasten the electronics mount 250 to the electronic device 210. Accordingly, the mount 200 can be "L" shaped, and can dispose the electronic device 210 away from the airplane seat 222, and the tray table 221, at a distance desirable to a user.

Figure 3A:
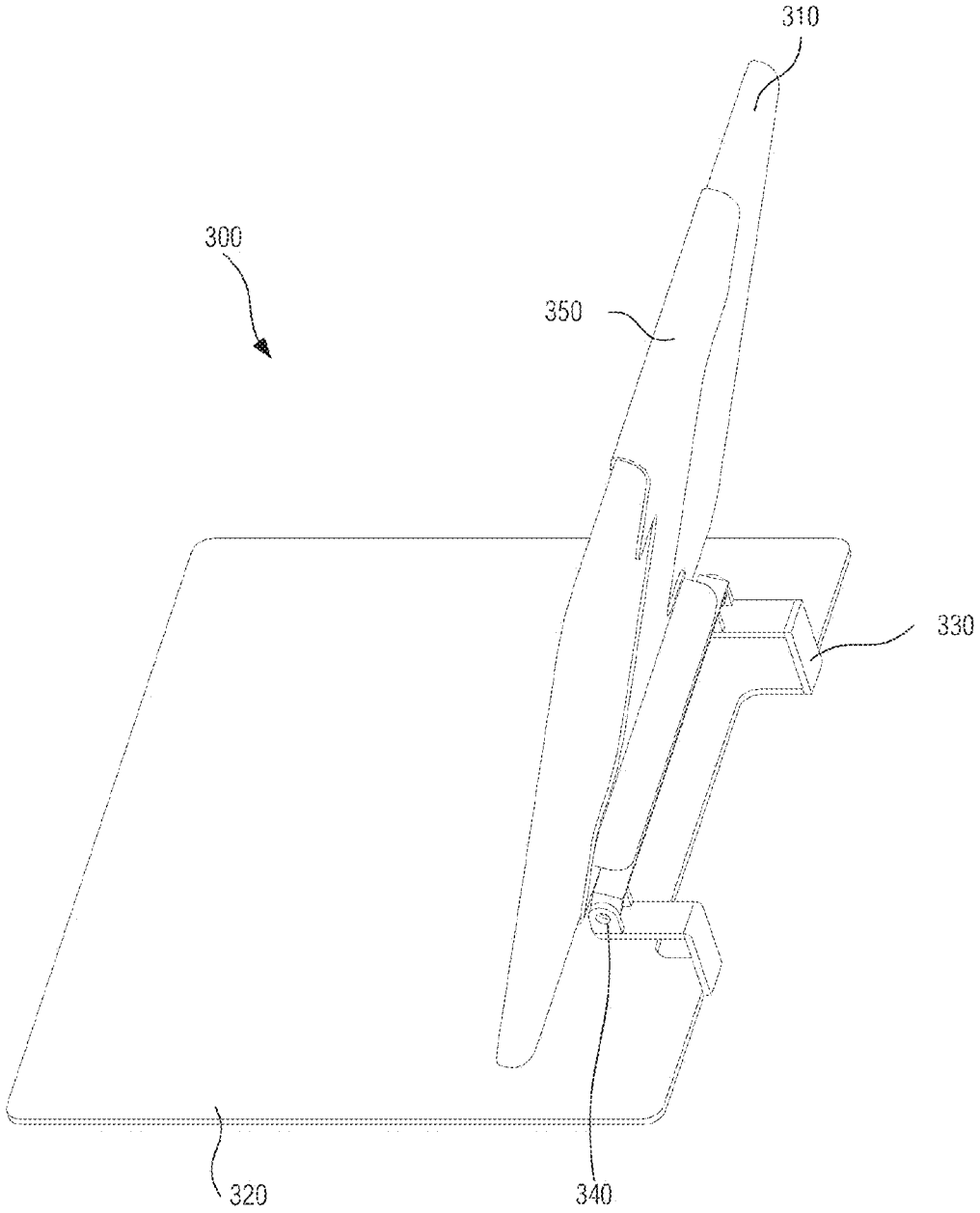
FIG. 3A shows a perspective view of a mount with one hinge in an open state, according to an example.

FIG. 3A shows a perspective view of a mount 300 with a first hinge 340 in an open state. In an example, the mount 300 can hold an electronic device 310, for example to elevate the electronic device 310 off of a tray table and more level with a natural viewing angle. The mount 300 can include a base 320. The base 320 is sized and shaped to fit between an airplane tray table, such as a tray table in an upright position, including tray tables locked into position, and a seat including a seatback. The base 320 can provide support for the mount 300, such as to support an electronic device 310.

Various examples include a cantilever 330 coupled with the base 320. In various examples, the base 320 provides support for the cantilever. In various examples, the cantilever 330 extends between the base and the electronics mount 350 to dispose the electronics mount 350 away from the airplane seat when the tray table is in a stowed state with the base 320 disposed between the tray table and the airplane seat.

As used herein, the term hinge extends to single degree of freedom rotational joints. The present subject matter is not so limited, however, and each joint can comprise multiple degree of freedom joints, including, but not limited to, ball-in-socket joints, joints with fasteners such as joints joining constituent parts with screws, magnets, reusable adhesive, hook-and-loop and the like, telescoping joints, and other joints. One or more joint of examples discussed herein can include detents to aid in adjusting to preconceived positions. Hinges can include locks, including two-state locks (locked/unlocked) as well as adjustable locks, including thumbscrews, ramped sliders or wedges, and the slide.

Figure 3B:
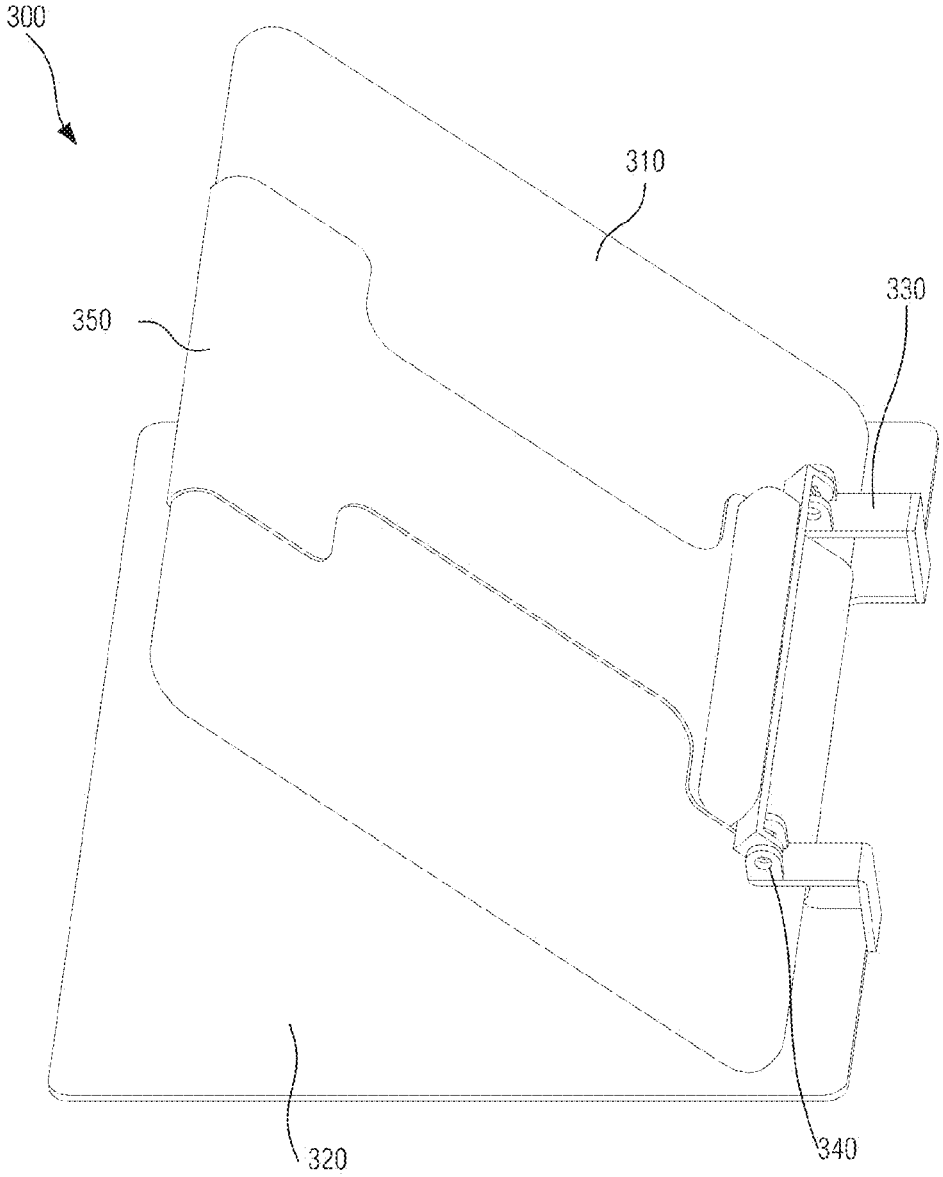
FIG. 3B shows a perspective view of a mount with one hinge in an open state, according to an example.
Figure 3C:
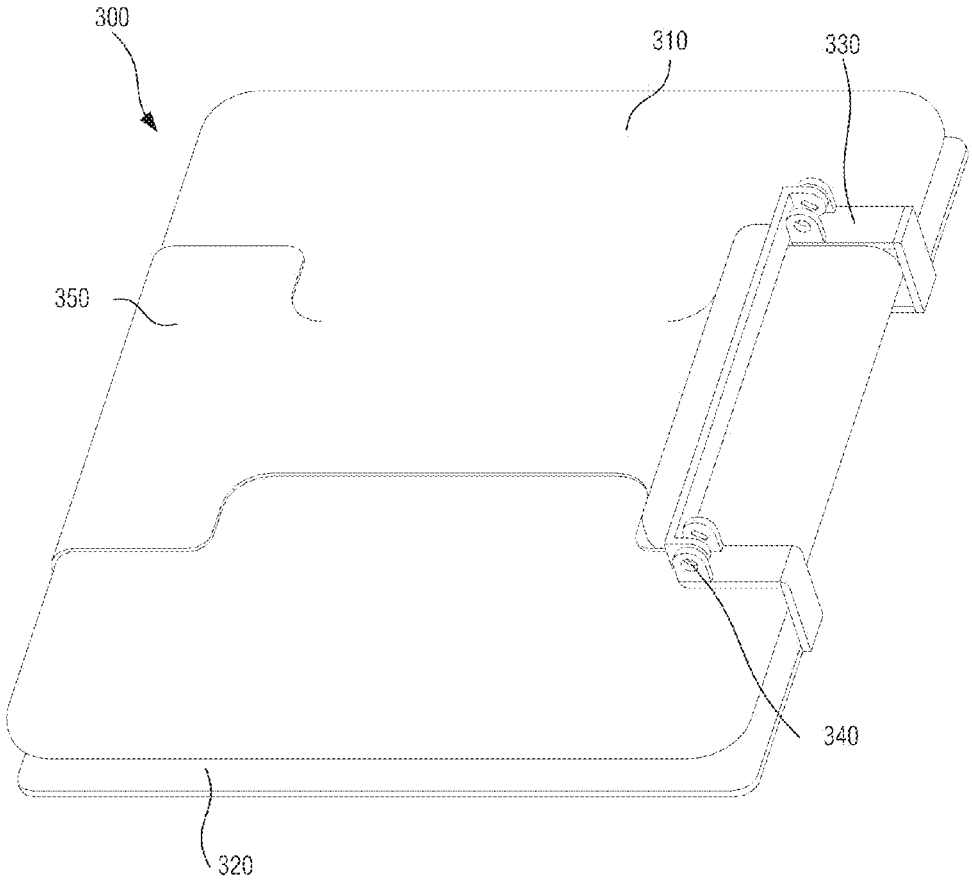
FIG. 3C shows a perspective view of a mount with one hinge in a closed state, according to an example.

The mount 300 can comprise a first hinge 340, for example to aid a user in adjusting the mount 300 from an open state, shown in FIG. 3A, to a closed state, show in FIG. 3B, or vice versa. FIG. 3B shows a perspective view of a mount 300 with a first hinge 340 in a partially open state. FIG. 3C shows a perspective view of a mount 300 with a first hinge 340 in a closed state. In a closed state the base 320 can be parallel with the display surface of the electronic device 310, such as to cover the display surface of the electronic device 310, partially or wholly. Such a configuration conveniently aids the user in stowing their electronic device 310 with its display screen being protected.

Figure 4A:
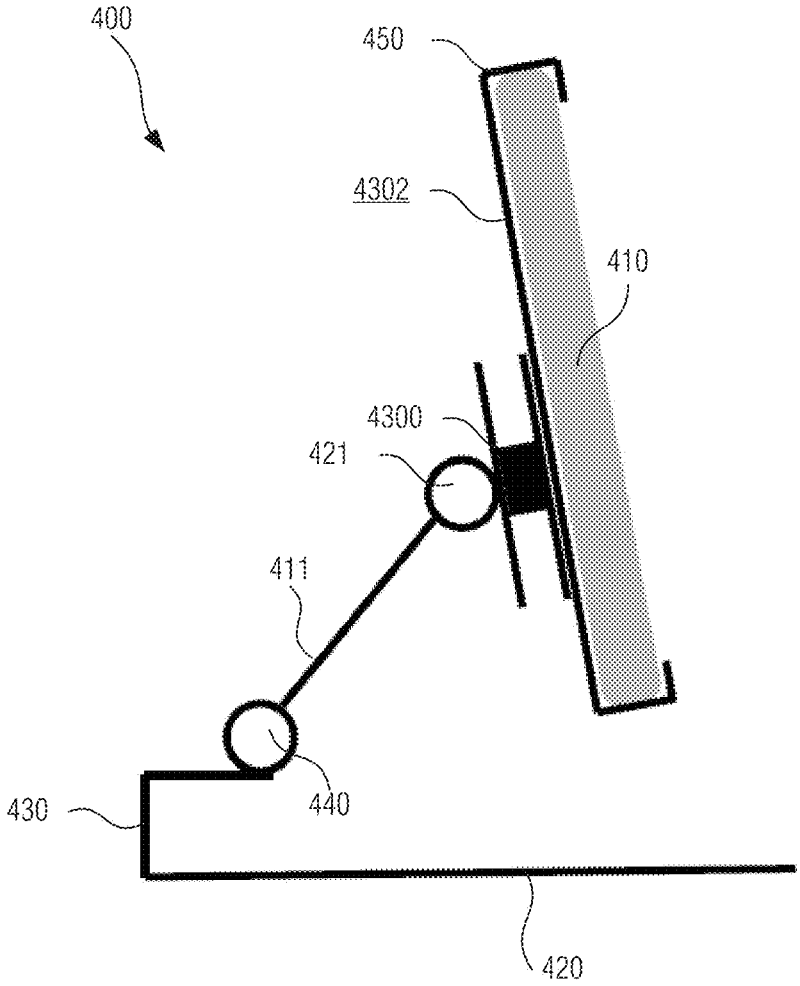
FIG. 4A shows a side view of a mount with a swivel in an open state, according to an example.

FIG. 4A shows a side view of a mount 400 with a swivel 4300, the mount 400 being in an open state. In an example, the mount 400 can hold an electronic device 410, for example to elevate the electronic device 410 off of a tray table and more level with a natural viewing angle. The mount 400 can include a base 420. The base 420 is sized and shaped to fit between an airplane tray table, such as a tray table in an upright position, including tray tables locked into position, and a seat including a seatback. The base 420 can provide support for the mount 400, such as to support an electronic device 410.

Various examples include a cantilever 430 coupled with the base 420. In various examples, the base 420 provides support for the cantilever. In various examples, the cantilever 430 is coupled with a riser or extension arm via a joint such as a hinge 440. As used herein, a riser can include a flat plate, an arm, or multiple arms. A second hinge 421 is coupled to the riser 411 opposite the first hinge, according to an example. In an example, the second hinge 421 is coupled to the electronics mount 450. Thus, the riser can adjustably position the electronics mount 450 away from the airplane seat when the tray table is in a stowed state with the base 420 disposed between the tray table and the airplane seat.

A swivel 4300 can rotate the electronics mount 450, to rotate the electronic device 410. A swivel joint 4300 can be coupled between a back 4302, which can be a planar back, of the electronics mount 450 and the riser 411, the swivel joint 4300 configured to allow the electronics mount 450 to swivel with the planar back disposed in a plane fixed with respect to the base 420. Rotating the electronic device 410 can aid the user in configuring the mount 400 into a desired configuration.

Figure 4B:
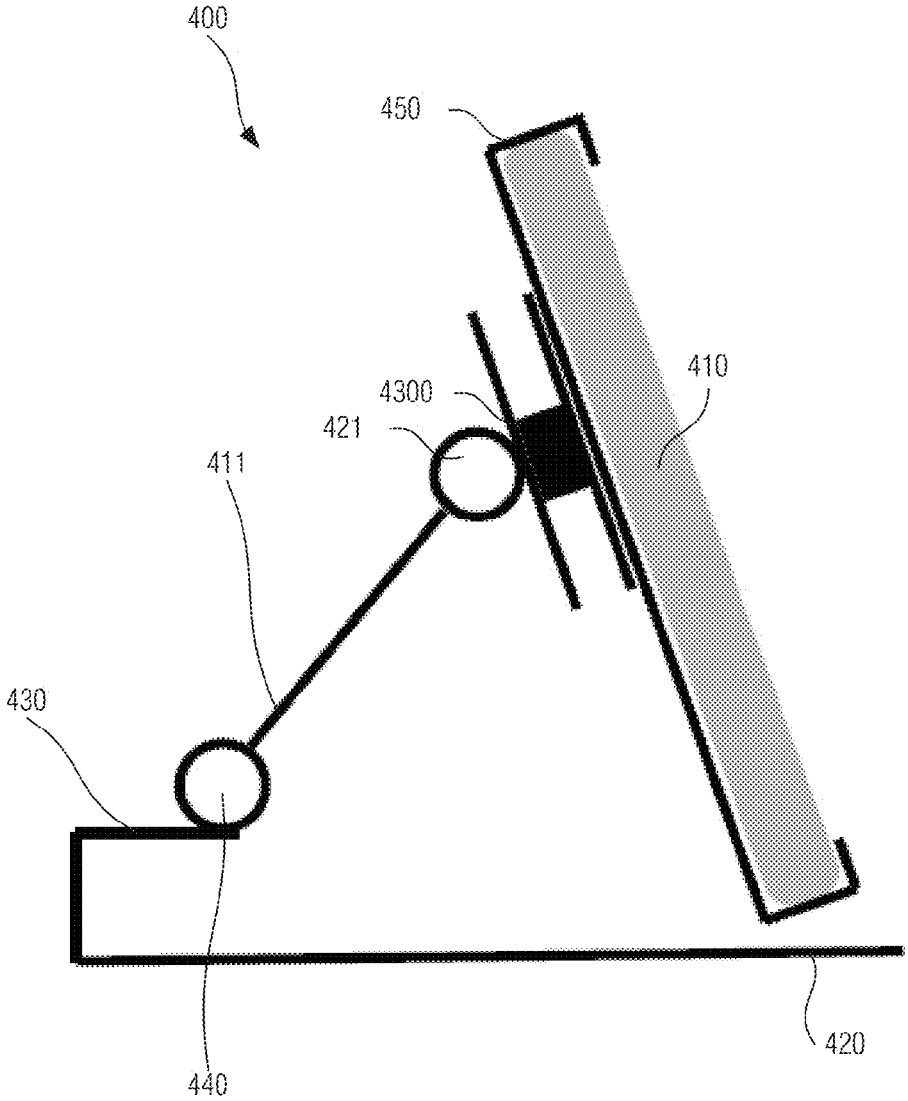
FIG. 4B shows a side view of a mount with a swivel in an open state, according to an example.
Figure 4C:
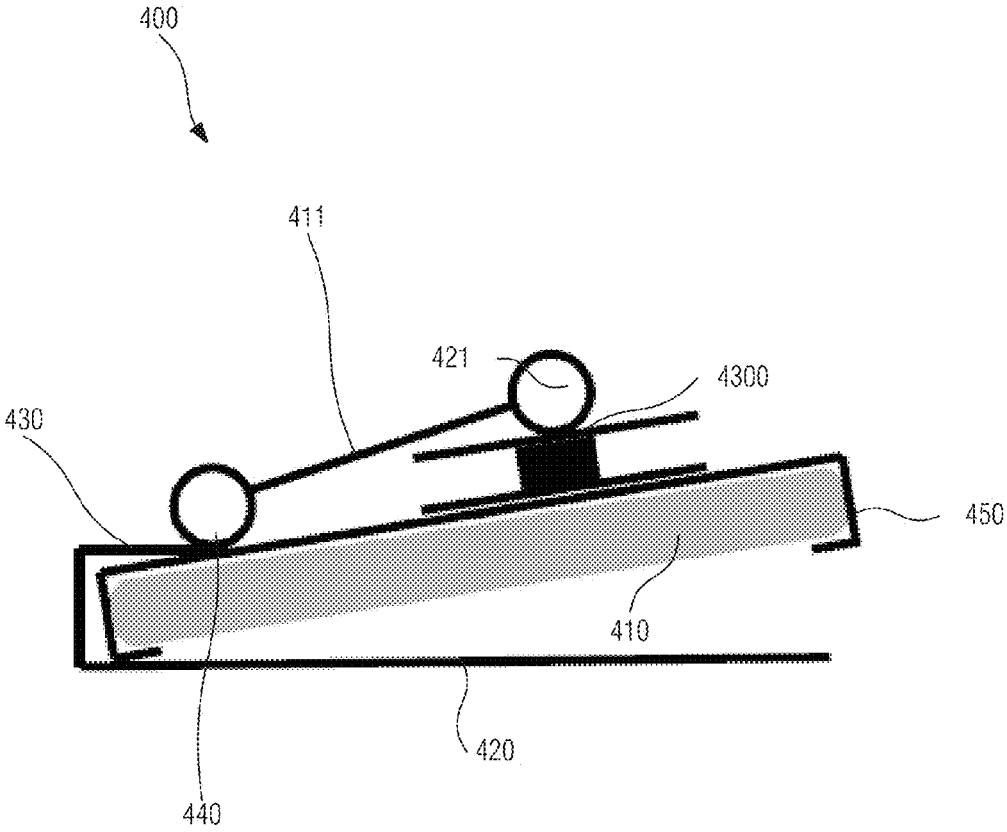
FIG. 4C shows a side view of a mount with a swivel in an open state, according to an example.
Figure 4D:
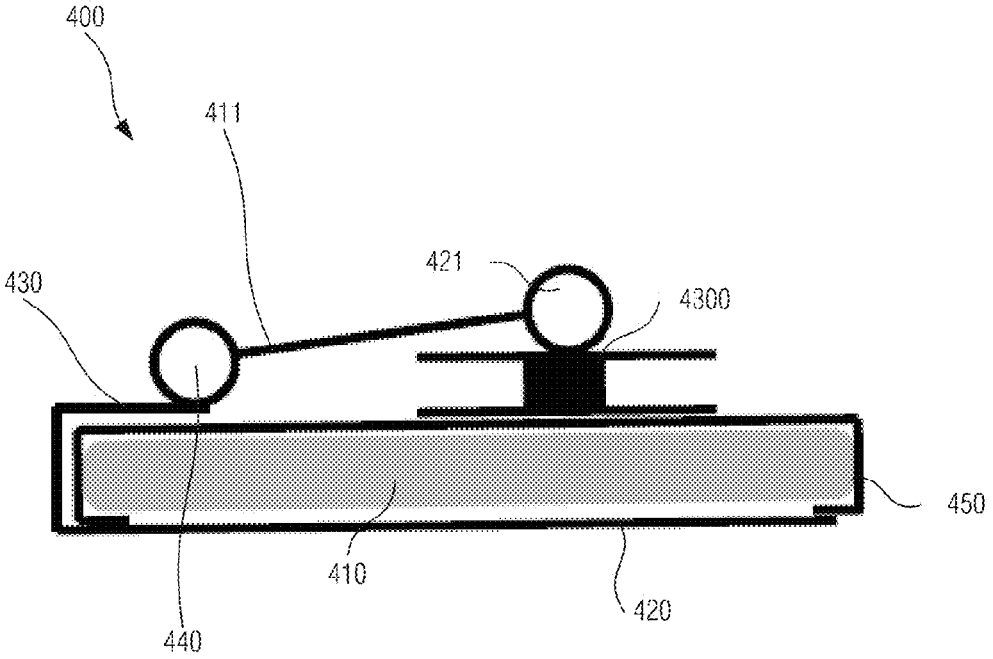
FIG. 4D shows a side view of a mount with a swivel in a closed state, according to an example.

FIG. 4B shows a side view of an electronics mount 450 with a swivel 4300, the mount being in an open state. The swivel 4300 can rotate the electronics mount 450 into a desired configuration, such as when the user is configuring the mount 400 from an open state to a closed state. FIG. 4C shows a side view of a mount 400 with a swivel 4300 in a partially open state. The swivel 4300 can rotate the electronics mount 450 into a desired configuration. FIG. 4D shows a side view of a mount 400 with a swivel 4300 in a closed state. The swivel 4300 can rotate the electronics mount 450 into a desired configuration, such as a closed state.

Figure 5A:
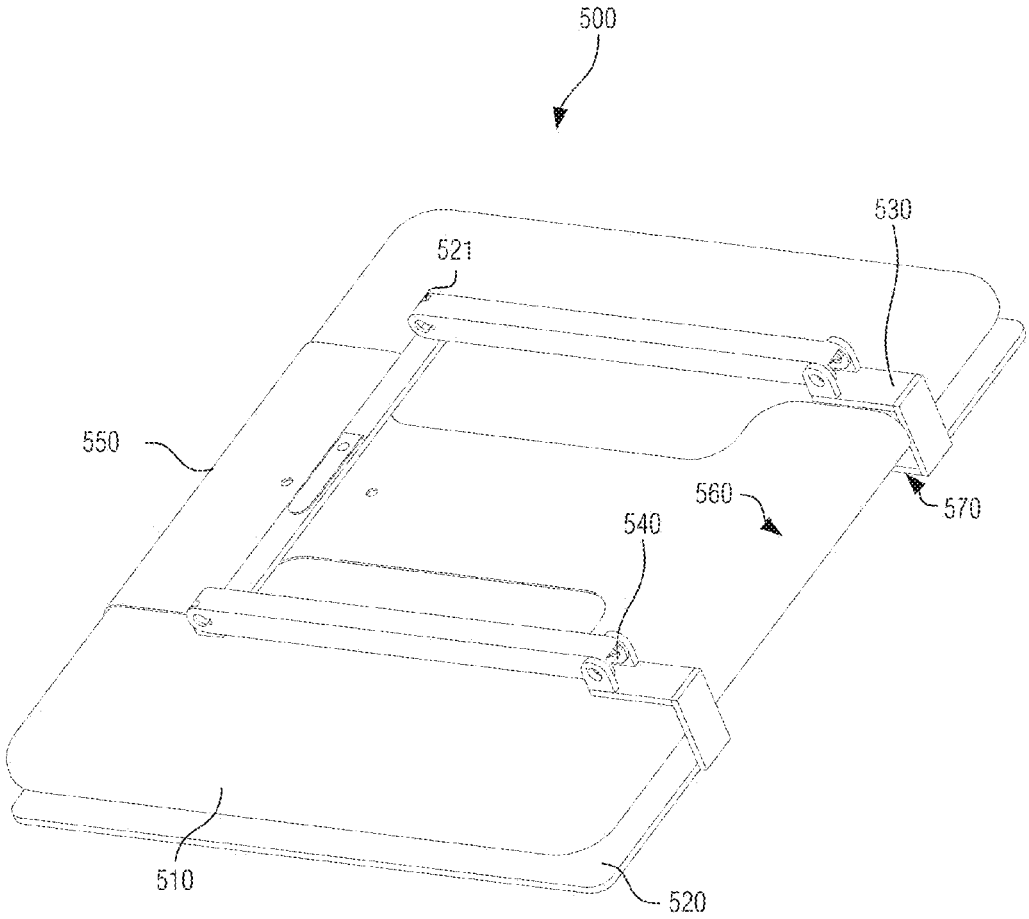
FIG. 5A shows a perspective view of a mount mounting an electronic device, according to an example.

FIG. 5A shows a perspective view of a mount 500 mounting an electronic device 510. In an example, the mount 500 can hold an electronic device 510, for example to elevate the electronic device 510. The mount 500 can hold an electronic device 510, for example to position the electronic device 510 in a desired position for the user.

The mount 500 can include a base 520. The base can be shaped to conform to a plane, such as a planar void, such as to fit between an airplane tray table in an upright and locked position and a seat. The base 520 can provide support for the mount 500, such as when the mount 500 is mounting an electronic device 510. The base 520 can be coupled to a pair of cantilevers 530, for example to support the pair of cantilevers 530. The pair of cantilevers 530 can be coupled to a first hinge 540, such as to create separation between the first hinge 540 and the base 520. The pair of cantilevers 530 can be "L" shaped, for example to create a separation between the first hinge 540 and the base 520. An electronics mount 550 can be coupled to that first hinge 540. The electronics mount 550 can be coupled to the electronic device 510, such as to secure the electronic device 510 to the mount 500. Although the electronics mount 550 is shown coupled with a top and bottom of the electronic device 510, some examples couple to only portion of the electronic device, sides, or other aspects of the electronic device, including recessed fasteners disposed in the back of the electronic device, examples of which can be arranged in a standard pattern such as those agreed upon by industry trade groups.

In an example, the pair of cantilevers 530 can define a first void 560. The first void 560 can be sized and shaped, or otherwise configured to extend around the perimeter of a locking device, such as the rotating lever that swings from a seatback and onto a tray table to lock the tray table into a stowed position. In an example, the mount 500 is mounted on an airplane seat with the tray table in an upright and locked position. The first void 560 can be configured to extend around a locking device, for example to define a clearance between the pair of cantilevers 530 and the locking device of the airplane tray table.

Some examples create a void only between cantilevers, while in additional examples, the base 520 can define a second void 570. The second void 570 can be sized and shaped, or otherwise configured to extend around a locking device, such as when the mount 500 is mounted on an airplane tray table and the airplane tray table is in an upright and locked position. The second void 570 can be sized and shaped, or otherwise configured to extend around the perimeter of a locking device. The airplane table can be in an upright and locked position. The second void 570 can be configured to extend around a locking device, for example to define a clearance between the base 520 and the locking device of the airplane tray table. The base 520 can define a second void 570 that is "U" shaped. In the illustrated example, the first and second voids are continuous, but the present subject matter is not so limited.

Figure 5B:
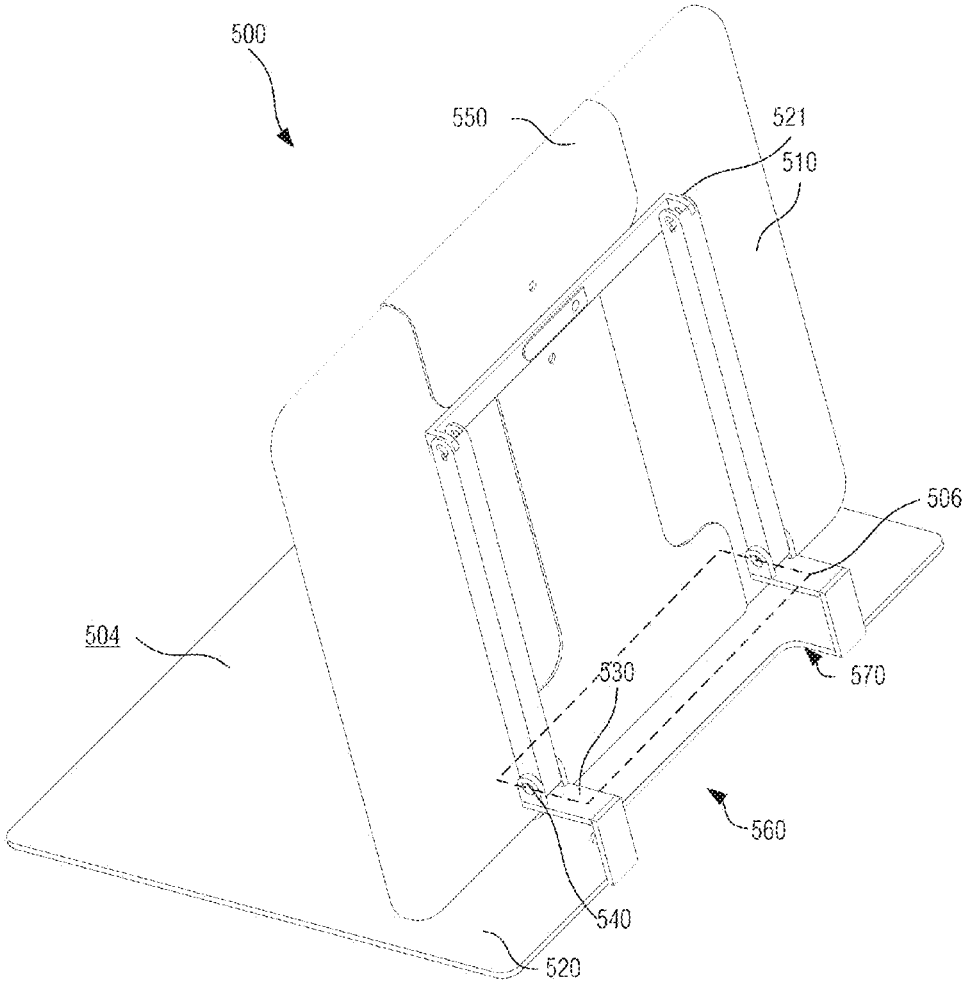
FIG. 5B shows a perspective view of a mount mounting an electronic device, according to an example.

As illustrated in FIG. 5B, the base 520 can extend along a first reference plane 504 and the first hinge 540 can be in a second reference plane 506, such as to space the base 520 away from the first hinge 540. In an example, the first reference plane 504 can be parallel to the second reference plane. There can be a space between the base 520 and the first hinge 540 to receive an object such as an airplane tray table or an electronic device 510 (see FIG. 4D for an example), such as approximately between ¾" and 5½". The space between the base 520 and the first hinge 540 can be small enough that an airplane tray table or an electronic device 510 is, at least partially, constrained within the space.

The mount 500 can be in a closed state, such as shown in FIG. 5A. In a closed state, the mount 500 can locate the display side of an electronic device 510 closely to the base 520, for example to protect the display side of an electronic device 510 from damage. The display side of an electronic device 510 can be damaged, such as during transportation of the electronic device 510. The base 520, when located closely to the display side of the electronic device 510 can protect the display side of the electronic device 510, such as by absorbing or deflecting external hazards. The base 520 can be configured to a substantially similar size and shape of the display surface of the electronic device 510, such as to protect the display surface of the electronic device 510.

FIG. 5B shows a perspective view of a mount 500 mounting an electronic device 510, the mount being in an open state. In an open state, the mount 500 can hold the electronic device 510 in a position where the display surface of the electronic device can be visible to a user. In an open state the display surface of the electronic device 510 can be exposed, for example to allow a user to interact with the electronic device 510, or simply watch the device.

As referenced above, the mount 500 can be mounted on the back of an airplane seat. The airplane seat can include an airplane tray table. The airplane tray table can be mounted on the back of the airplane seat, such as for the passenger in the next rearward row to use. The airplane tray table can include a locking device. In an example, the airplane tray table can be opened, such that the airplane tray table is approximately perpendicular to the seat back. The mount 500 can be in an opened state, such as to expose the display surface of the electronic device 510 to the user. The base 520 can be placed on the airplane tray table. The airplane tray table can be moved to an upright position. The airplane tray table can be locked in the upright position, such as with the locking device. In an example, the airplane tray table can support the mount 500, for example to allow a user to view the electronic device 510.

Figure 5C:
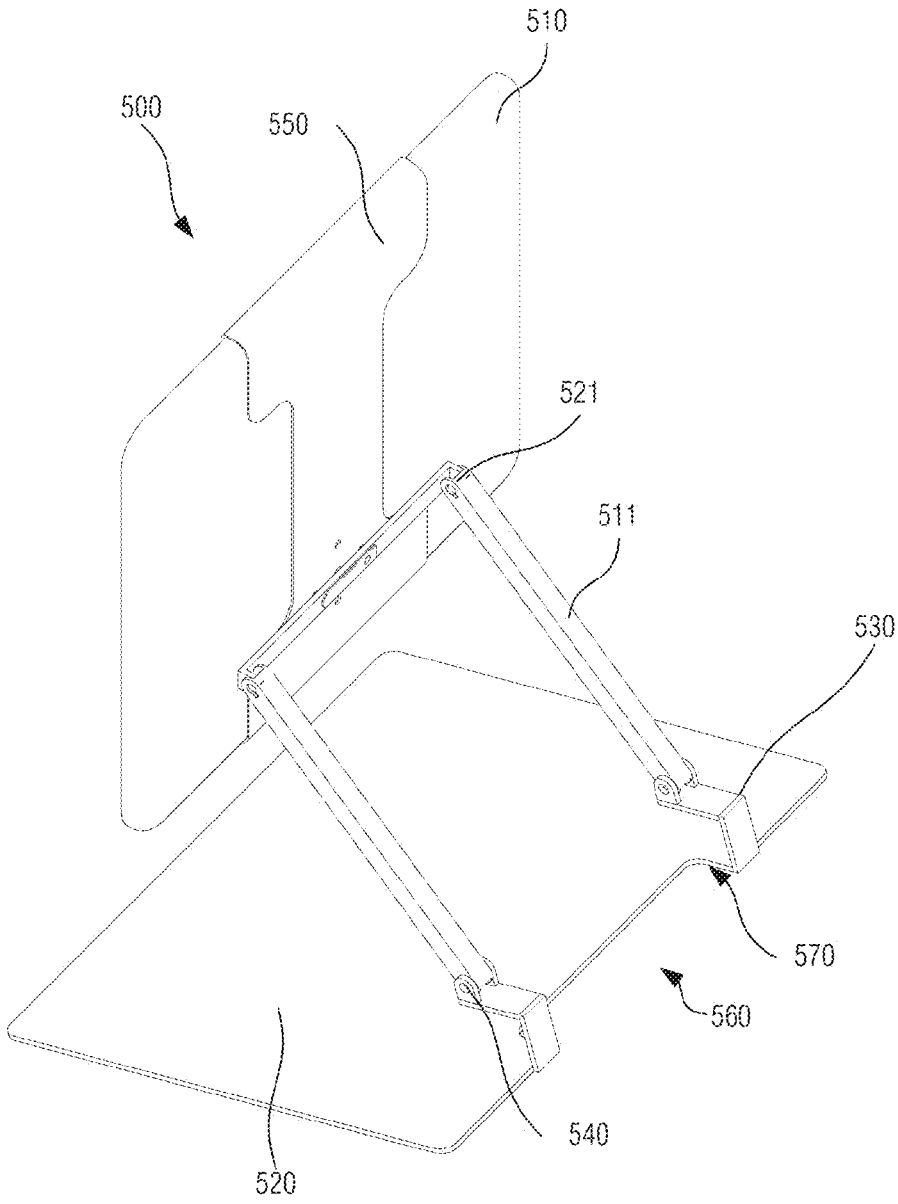
FIG. 5C shows a perspective view of a mount with arms extending from a first hinge to a second hinge element, according to an example.

FIG. 5C shows a perspective view of a mount 500 with two arms 511 extending from a first hinge 540 to a second hinge 521, the mount being in an open state. The mount 500 can include a second hinge 521, such as to allow an adjustment in relation to the arms 511. The second hinge 521 can allow the user to tilt or otherwise adjust the electronic device 510, such as into a user desired location.

The hinge elements 540, 521 can comprise a set screw, such as for providing sufficient resistance to support the electronic device in a user desired location. The set screw can be hand tightened, such as by a user, for example to secure the mount 500 in the desired configuration. The hinge elements 540, 521 can include sufficient tension to keep the mount 500 in a desired configuration without additional support. The hinge elements 540, 521 can include sufficient tension to adjust the mount by a user, such as to configure the mount 500 in a desired configuration.

Figure 5D:
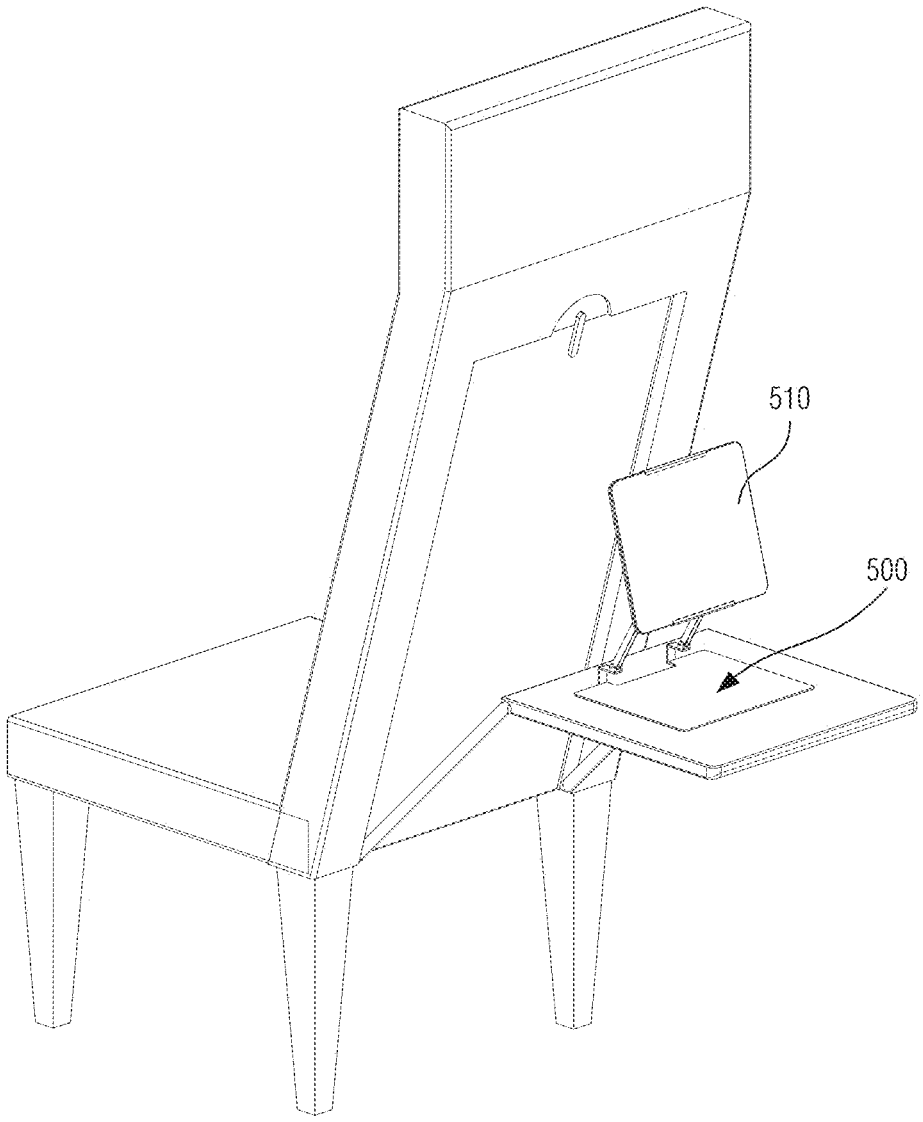
FIG. 5D shows a perspective view of a mount mounting an electronic device on an airplane tray table, according to an example.

FIG. 5D shows a perspective view of a mount 500 mounting an electronic device 510 on an airplane tray table, according to an example. The mount 500 can position an electronic device 510 with the base 520 of the mount on an airplane tray table, such as if the user wants to use the electronic device with an accessory. The mount 500 can hold the electronic device 510 and the airplane tray table can be in an open position, such as for the user to use the airplane tray table at the same time as using the electronic device 510. Using the airplane tray table at the same time as the using the electronic device, can allow the user to be more efficient, such as if the user wants to write in a notebook that is on the tray table, while using an electronic device 510.

Figure 5E:
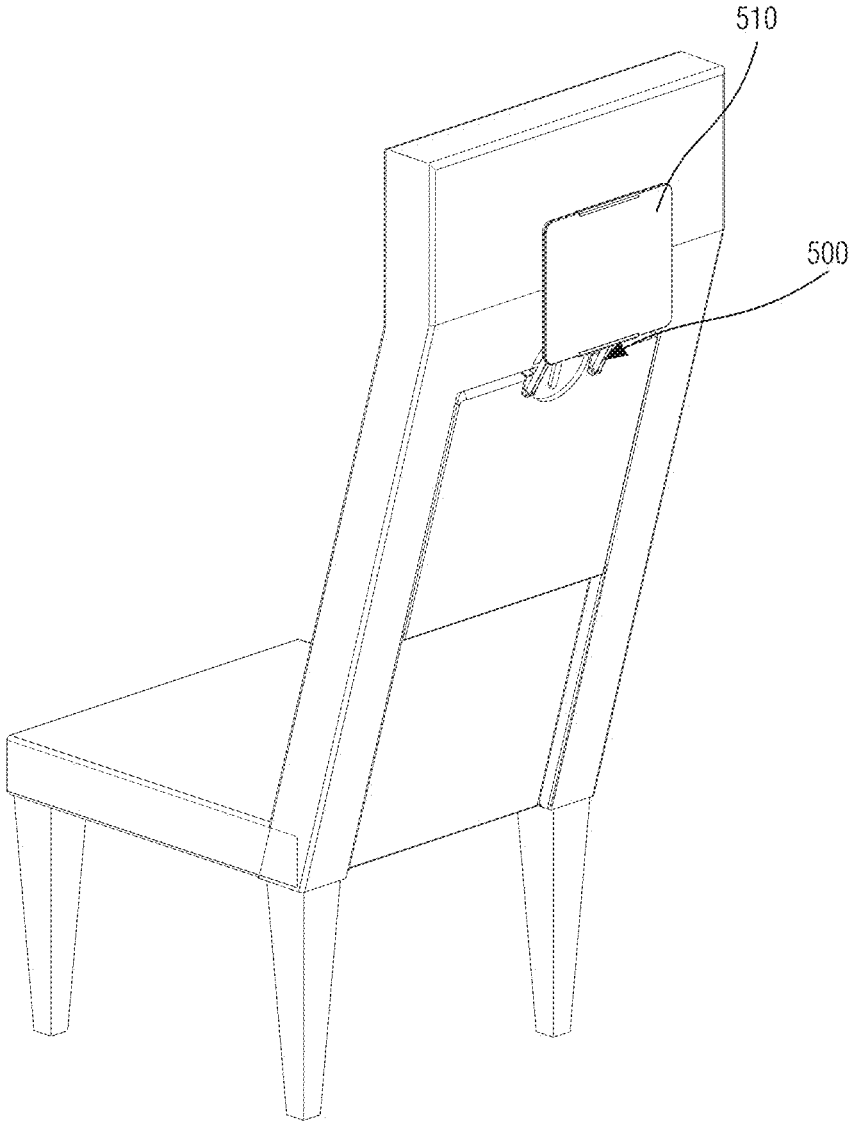
FIG. 5E shows a perspective view of a mount in use with an airplane tray table, according to an example.

FIG. 5E shows a perspective view of a mount in use with an airplane tray table, according to an example. The mount 500 can be mounted on the back of an airplane seat, such as by locking the base 520 in between the airplane tray table and the seat.

Figure 6A:
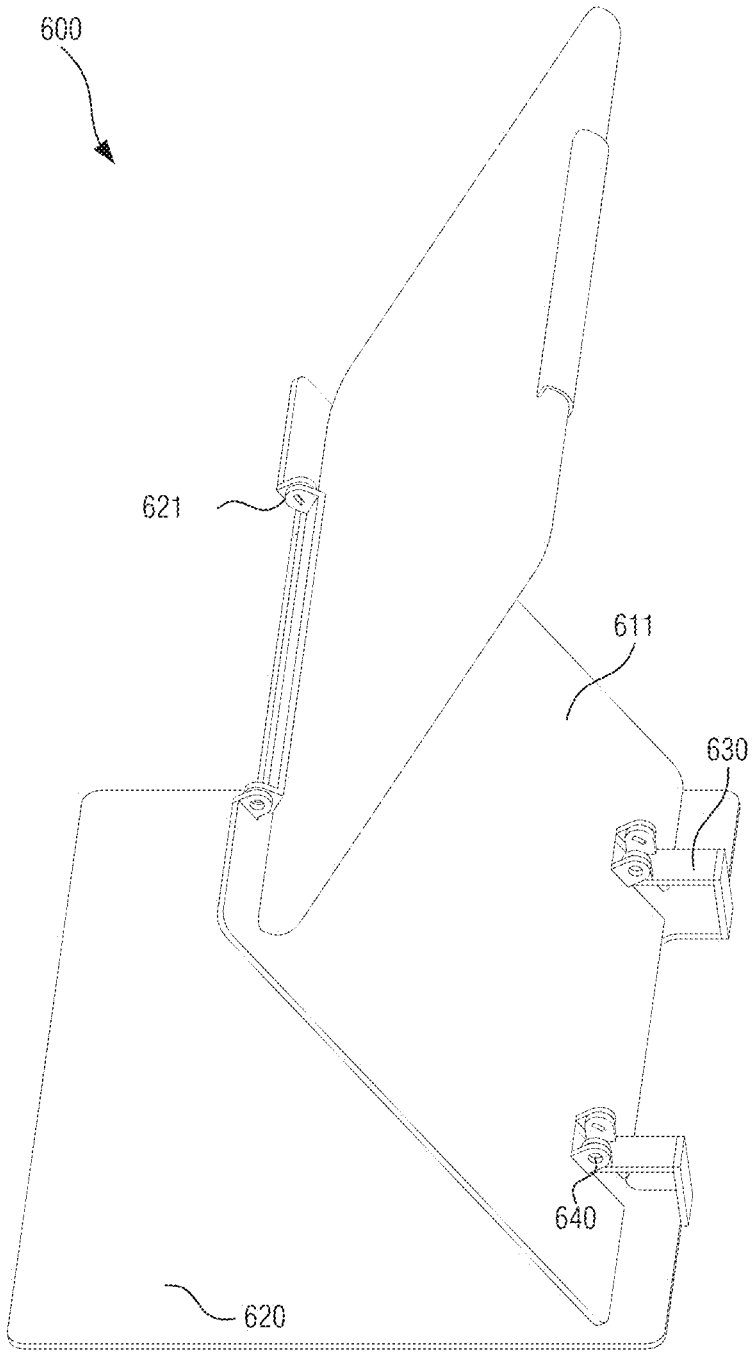
FIG. 6A shows a perspective view of a mount with two hinge elements in an open state, according to an example.

FIG. 6A shows a perspective view of a mount 600 with two hinge elements 640, 621, the mount being in an open state. In an example, the mount 600 can hold an electronic device 610, for example to elevate the electronic device 610 off of a tray table and more level with a natural viewing angle. The mount 600 can include a base 620. The base 620 is sized and shaped to fit between an airplane tray table, such as a tray table in an upright position, including tray tables locked into position, and a seat including a seatback. The base 620 can provide support for the mount 600, such as to support an electronic device 610.

Various examples include a cantilever 630 coupled with the base 620. In various examples, the base 620 provides support for the cantilever. In various examples, the cantilever 630 is coupled with a riser or extension arm via a joint such as a hinge 640. The mount 600 can include a first hinge 640 and a second hinge 621. In an open state, such as shown in FIG. 6A, a user can place an accessory on the base 620, such as an accessory to be used in combination with the electronic device. An accessory to be used with an electronic device can comprise a mouse or a keyboard.

Figure 6B:
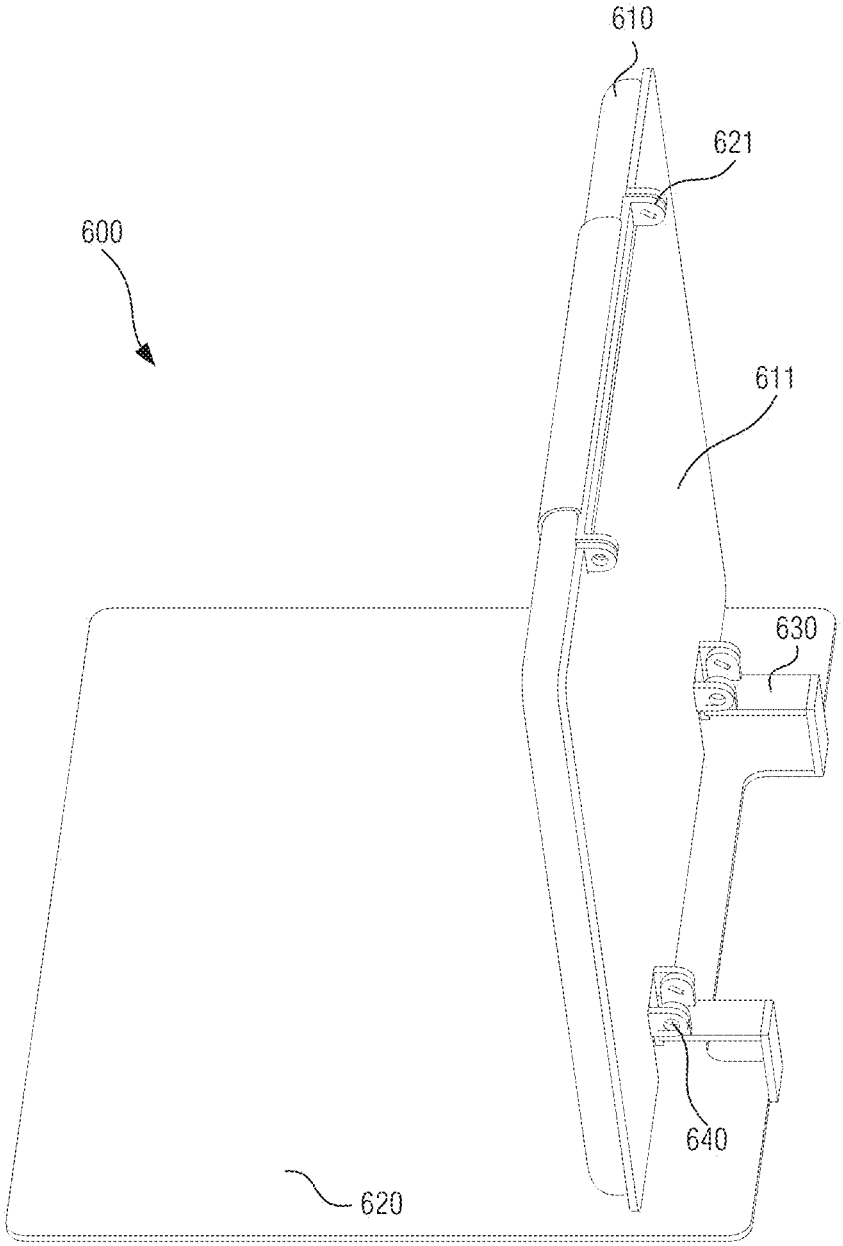
FIG. 6B shows a perspective view of a mount with two hinge elements in an open state, according to an example.

FIG. 6B shows a perspective view of a mount 600 with two hinge elements 640, 621 in a partially open state. The mount 600 can be in a partially open state, such as when it is not fully open or fully closed.

Figure 6C:
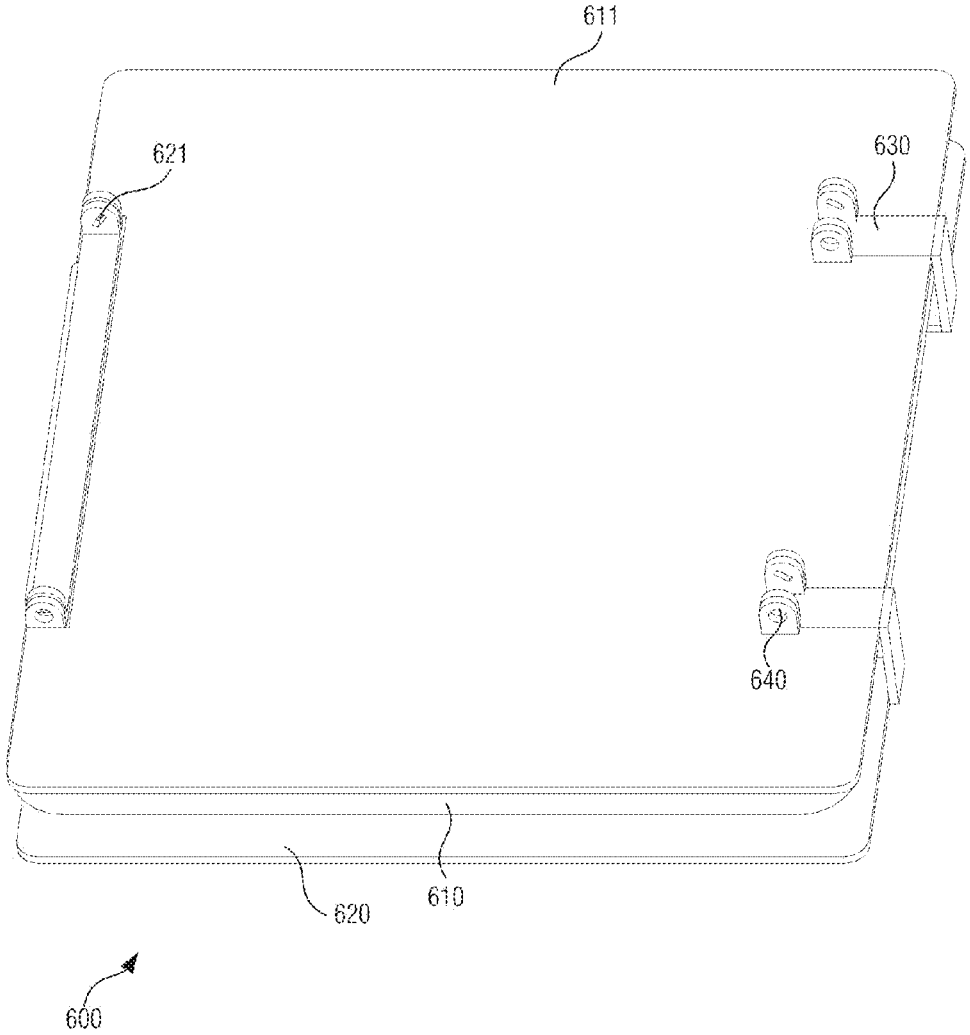
FIG. 6C shows a perspective view of a mount with two hinge elements in a closed state, according to an example.

FIG. 6C shows a perspective view of a mount 600 with two hinge elements 640, 621 in a closed state. In a closed state, the arm 611 can cover the display surface of the electronic device 610, such as when the arm 611 is configured to be similarly sized and shaped as the display surface of the electronic device 610. In an example, the display surface of the electronic device 610 can be accessible to the user in a closed state, such as when the arm 611 does not cover the display surface of the electronic device 610.

Figure 7A:
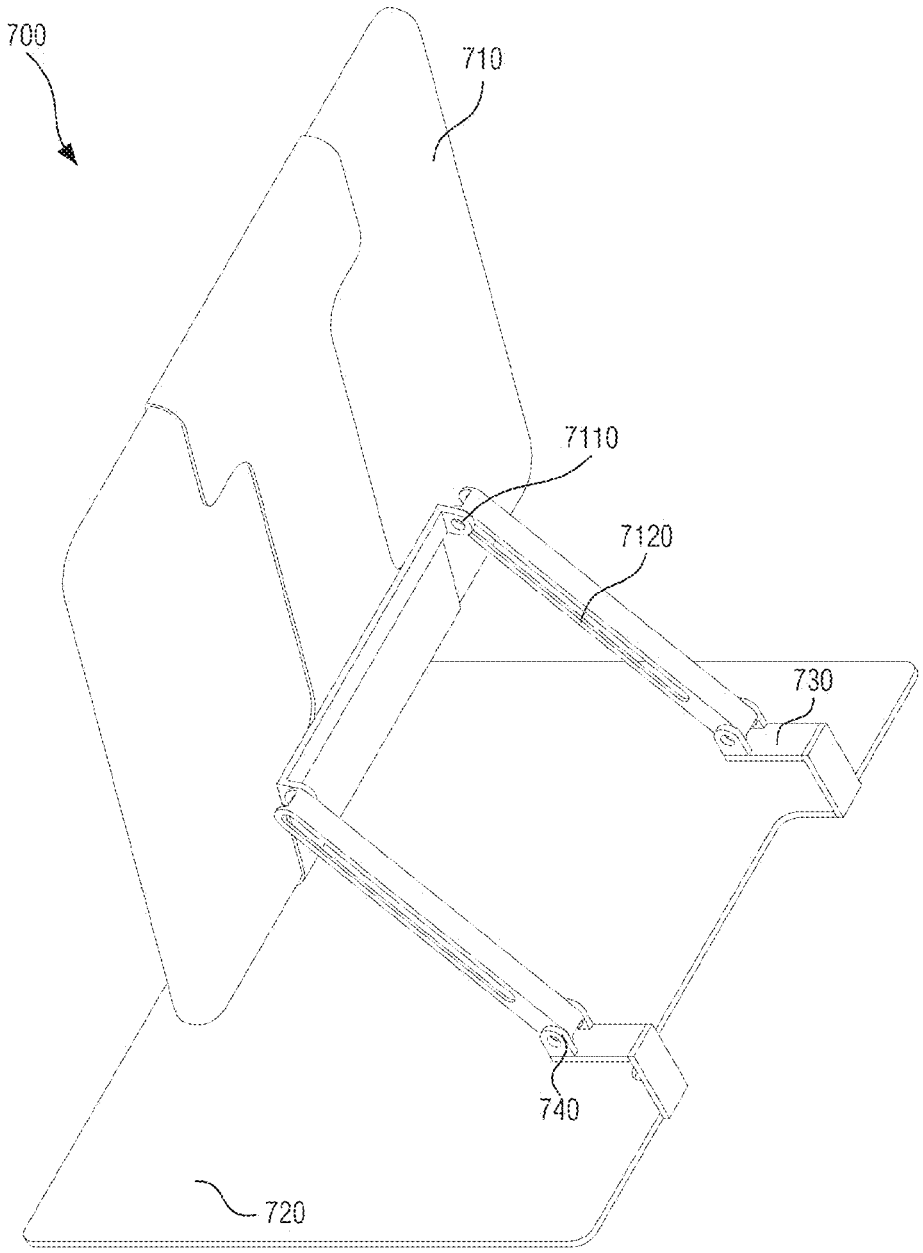
FIG. 7A shows a perspective view of a mount with two hinge elements, one of which is a slideable hinge in an open state, according to an example.

FIG. 7A shows a perspective view of a mount 700 with a slideable hinge 7110 and a first hinge 740, the mount being in an open state. In an example, the mount 700 can hold an electronic device 710, for example to elevate the electronic device 710 off of a tray table and more level with a natural viewing angle. The mount 700 can include a base 720. The base 720 is sized and shaped to fit between an airplane tray table, such as a tray table in an upright position, including tray tables locked into position, and a seat including a seatback. The base 720 can provide support for the mount 700, such as to support an electronic device 710.

Various examples include a cantilever 730 coupled with the base 720. In various examples, the base 720 provides support for the cantilever. In various examples, the cantilever 730 is coupled with a riser or extension arm via a joint such as a hinge 740.

In an example, a riser is telescoping. Examples of telescoping arms include arms threaded for axial adjustment, arms including parts slideable into and out of other parts, and other telescoping designs. In an example, the mount 700 can comprise a slideable hinge 7110. The mount 700 can define a channel 7120, such as for the slideable hinge 7110 to slide within. The slideable hinge 7110 can move in relation to the mount 700. The movement of the slideable hinge 7110 can be restricted within the boundaries of the channel 7120. The slideable hinge 7110 can comprise a set screw, such as to allow the user to secure the slideable hinge 7110 into a desired location. The slideable hinge 7110 can comprise sufficient tension for example to restrict the movement of the slideable hinge 7110 within the channel 7120 when a user does not apply a force to the slideable hinge 7110.

Figure 7B:
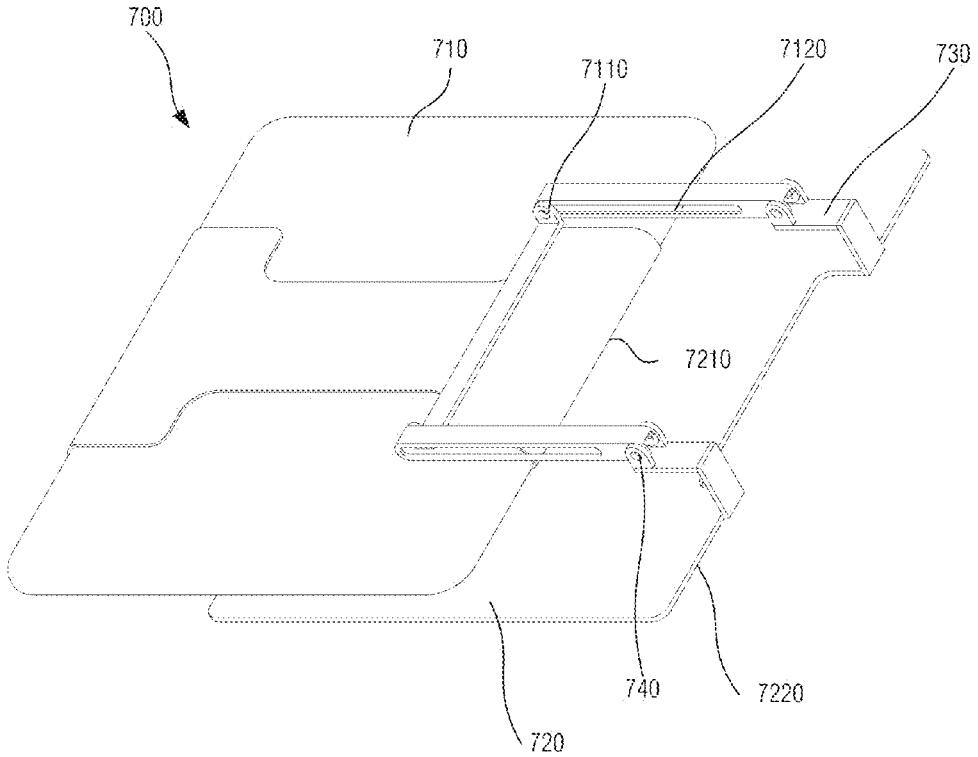
FIG. 7B shows a perspective view of a mount with two hinge elements, one of which is a slideable hinge in a closed state, according to an example.

FIG. 7B shows a perspective view of a mount 700 with two hinge elements 740, 7110 in a closed state. In a closed state the base 720 can be parallel with the display surface of the electronic device 710, such as to protect the display surface. The slideable hinge 7110 can slide to the end of the channel 7120, for example to align the end of the mount 7210 with the end of the base 7220.

Figure 8A:
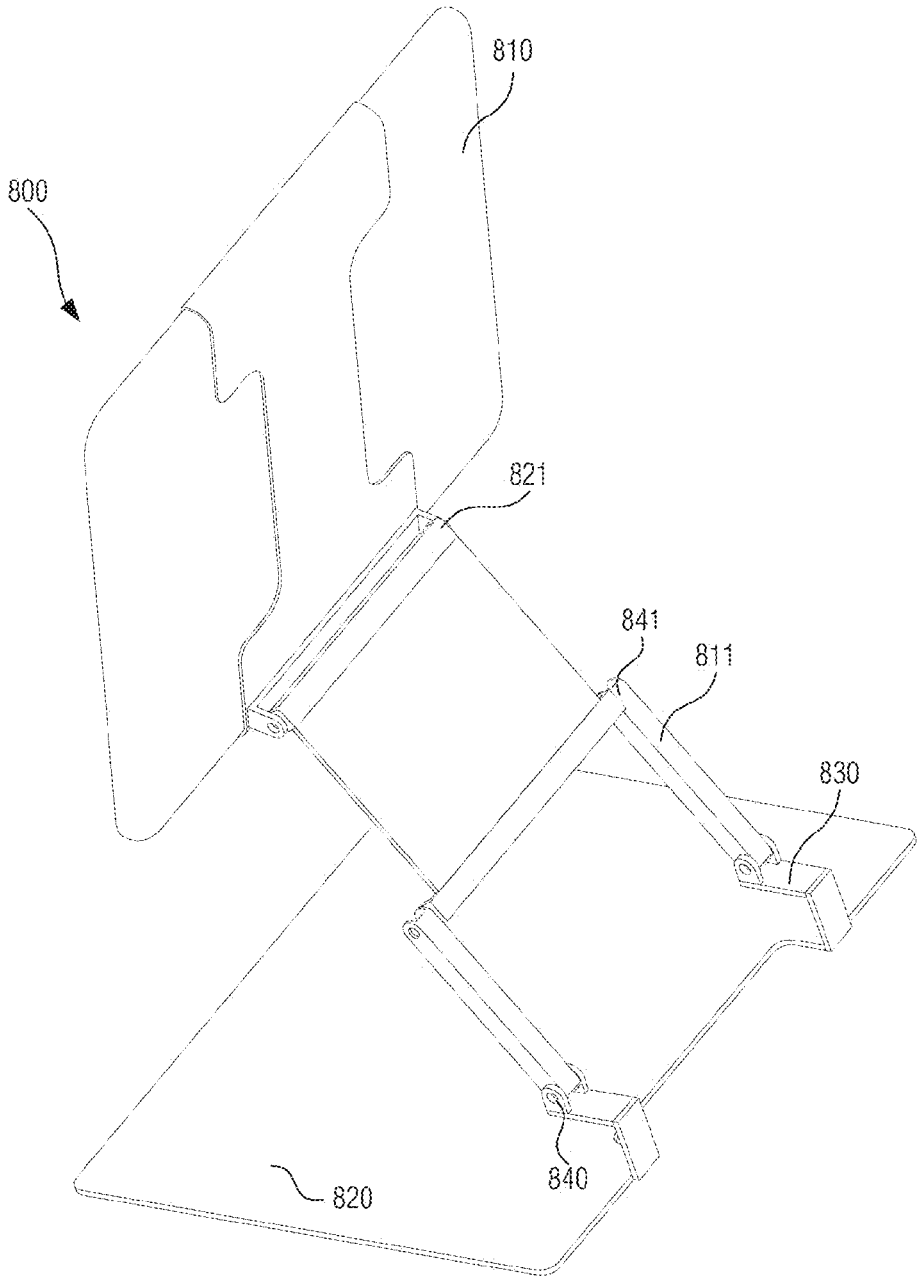
FIG. 8A shows a perspective view of a mount with three hinge elements in an open state, according to an example.

FIG. 8A shows a perspective view of a mount 800 with three hinge elements 841, 821, 830, the mount being in an open state, according to an example. In an example, the mount 800 can hold an electronic device 810, for example to elevate the electronic device 810 off of a tray table and more level with a natural viewing angle. The mount 800 can include a base 820. The base 820 is sized and shaped to fit between an airplane tray table, such as a tray table in an upright position, including tray tables locked into position, and a seat including a seatback. The base 820 can provide support for the mount 800, such as to support an electronic device 810.

Various examples include a cantilever 830 coupled with the base 820. In various examples, the base 820 provides support for the cantilever. In various examples, the cantilever 830 is coupled with a riser or extension arm via a joint such as a hinge 840.

The arms 811 can include a third hinge 841, for example to provide an additional adjustment. An additional adjustment can aid a user in configuring the mount 800 into a desired configuration. In an example, the mount can comprise a three hinge element 840, 821, 841, such as for three different adjustments. The three different adjustments can provide the user with the ability to configure the mount 800 to a specific viewing location.

Figure 8B:
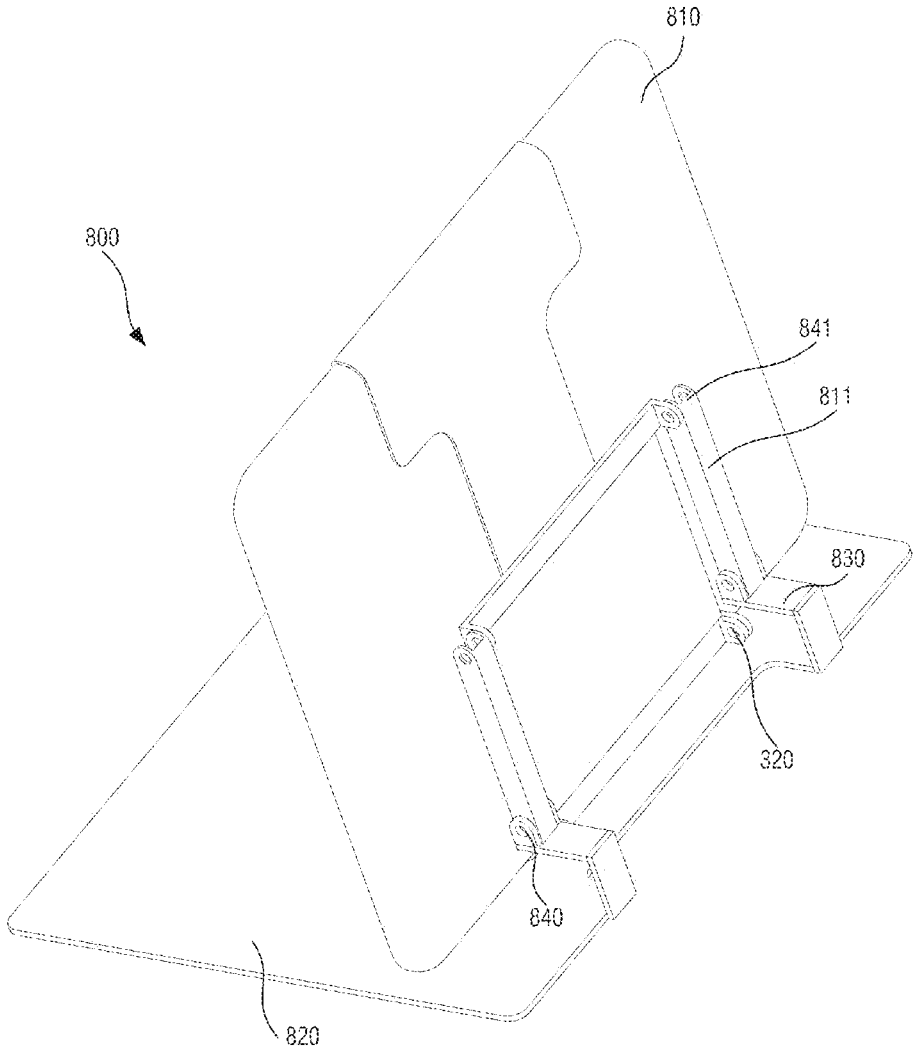
FIG. 8B shows a perspective view of a mount with three hinge elements in an open state, according to an example.
Figure 8C:
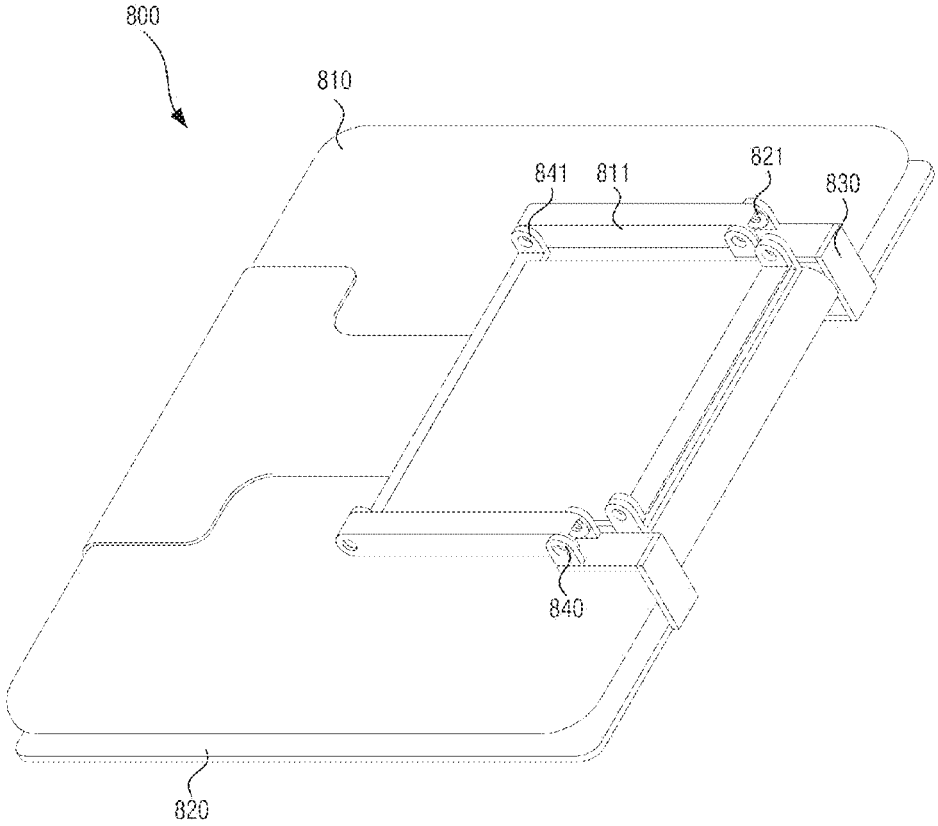
FIG. 8C shows a perspective view of a mount with three hinge elements in a closed state, according to an example.

FIG. 8B shows a perspective view of a mount 800 with three hinge elements 841, 821, 830, the mount being in an open state, according to an example. In an example, the three hinge elements 841, 821, 830 can be in a configuration similar to a mount 800 with one hinge 841. The mount 800 can include more than three hinge elements 841, 821, 830, such as to allow the user to configure the mount 800 into additional configurations. FIG. 8C shows a perspective view of a mount 800 with three hinge elements 841, 821, 840 in a closed state, according to an example.

Various Notes & Examples

Example 1 includes an apparatus for removable attachment between an electronic device and a tray table coupled to an airplane seat, including: an electronics mount adapted to removably fasten to the electronic device; a base coupled to the electronics mount, the base shaped to conform to a plane and sized and shaped to fit between the tray table and the airplane seat; and a cantilever extending between the base and the electronics mount, the cantilever having a cantilever length at least as long as a thickness of tray table to dispose the electronics mount away from the airplane seat when the tray table is in a stowed state with the base disposed between the tray table and the airplane seat.

Example 2 includes any of the preceding examples, wherein the cantilever includes two discrete portions disposed on opposite sides of the base.

Example 3 includes any of the preceding examples, wherein the base defines a void sized for passage of a fastener that is configured to fasten the tray table to the airplane seat in the stowed state.

Example 4 includes any of the preceding examples, including a hinge between the electronics mount and the base, the hinge configured to rotate the electronics mount with respect to the base.

Example 5 includes any of the preceding examples, including: a first hinge coupled to the electronics mount; a riser coupled to the first hinge; and a second hinge coupled to the riser opposite the first hinge, the second hinge coupled to the cantilever, wherein the electronics mount is coupled to the base via the riser.

Example 6 includes any of the preceding examples, wherein the riser is between 2 and 200 millimeters in length.

Example 7 includes any of the preceding examples, including a swivel joint coupled between a planar back of the electronics mount and the riser, the swivel joint configured to allow the electronics mount to swivel with the back disposed in a plane fixed with respect to the base.

Example 8 includes any of the preceding examples, including a swivel joint coupled between a planar back of the electronics mount and the base, the swivel joint configured to allow the electronics mount to swivel with the back disposed in a plane fixed with respect to the base.

Example 9 includes any of the preceding examples, including: a first hinge coupled to the electronics mount; a riser coupled to the first hinge; and a second hinge coupled to the riser opposite the first hinge, the second hinge coupled to the cantilever, wherein the electronics mount is coupled to the base via the riser, and wherein the second hinge is configured to hinge the riser around an axis parallel the plane and spaced apart from the plane.

Example 10 includes any of the preceding examples, wherein the first hinge is constrained to rotate around a first hinge axis parallel the axis of the second hinge.

Example 11 includes any of the preceding examples, wherein the riser is telescoping.

Example 12 includes any of the preceding examples, wherein the cantilever includes two discrete portions disposed on opposite sides of the base and the base defines a void sized for passage of a fastener that is configured to fasten the tray table to the airplane seat in the stowed state, and including: a first hinge coupled to the electronics mount; a riser coupled to the first hinge; and a second hinge coupled to the riser opposite the first hinge, the second hinge coupled to the cantilever, wherein the electronics mount is coupled to the base via the riser and the riser includes two opposing arms disposed on opposite sides of the void.

Example 13 includes any of the preceding examples, wherein the two members of the cantilever are substantially planar and disposed substantially orthogonal to the planar portion of the base.

Example 14 includes any of the preceding examples, wherein the base is sized and shaped to fit into a recess in a back of the airplane seat.

Example 15 includes any of the preceding examples, wherein the apparatus is foldable into a retracted state in which a height of the apparatus less than or equal to the cantilever length.

Example 16 includes any of the preceding examples, including an apparatus for mounting an electronic device using an airplane seat tray table, including: an electronics mount adapted to removably fasten to the electronic device, the electronics mount including a planar back to abut a back of the electronic device; a first hinge coupled to the electronics mount and configured; a riser coupled to the first hinge and extending to a second hinge; and a base coupled to the riser via the second hinge, the base including a planar portion sized and shaped to fit into a recess in a back of the airplane seat, with the second hinge spaced apart from the planar portion and a cantilever portion extending between the planar portion and the second hinge, the cantilever having a cantilever length at least as long as a thickness of a wall of the recess of the airplane seat, the cantilever to dispose the second hinge cantilevered away from the airplane seat when the airplane seat tray table is in a stowed state with the base disposed in the recess between the tray table and the airplane seat, wherein the planar back of the electronics mount and the planar portion of the base are parallel to an axis of rotation of the first hinge and an axis of rotation of the second hinge.

Example 17 includes any of the preceding examples, wherein the base defines at least part of a void sized for passage of a fastener that fastens the tray table to the airplane seat in the stowed state.

Example 18 includes any of the preceding examples, wherein the cantilever includes two members disposed on opposite sides of the void, away from the base, each extending to hinge joints of the second hinge configured to rotate the riser around the axis, the hinge joints disposed on opposite sides of the void.

Example 19 includes any of the preceding examples, wherein the two members of the cantilever are substantially planar and disposed orthogonal to the planar portion of the base.

Example 20 includes any of the preceding examples, wherein the first hinge is a hinge configured to rotate around a first hinge axis parallel the axis of the second hinge.

Example 21 includes any of the preceding examples, including a swivel joint coupled between the first hinge and the planar back, configured to allow the electronics mount to swivel the planar back in a planar back plane.

Example 22 includes any of the preceding examples, wherein the base as a width that is at least as wide as a maximum side dimension of the electronic device.

Example 23 includes any of the preceding examples, wherein the apparatus is foldable into a retracted state in which a height of the apparatus less than or equal to the cantilever length.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Examples such as method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code can form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

This detailed description of the present invention refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. This detailed description is, therefore, not to be taken in a limiting sense, and the scope is defined only by the appended claims, along with the full scope of legal equivalents to which such claims are entitled.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. An apparatus for removable attachment between an electronic device and a tray table coupled to an airplane seat, comprising:

a base shaped to conform to a plane and sized and shaped to fit between the tray table and the airplane seat;

a cantilever coupled to the base, the cantilever having a cantilever length at least as long as an edge of tray table to extend away from a seat back of the airplane seat when the tray table is in a stowed state with the base disposed between the tray table and the airplane seat back, the cantilever to support the base hanging from the edge of the tray table;

an electronic mount coupled moveably coupled to the cantilever to be positioned away from the airplane seat, the electronic mount adapted to removably fasten to an electronic device including a screen, with the screen facing away from the cantilever, a first hinge coupled to the electronic mount;

a riser coupled to the first hinge; and a second hinge coupled to the riser on opposite the first hinge, the second hinge coupled to the cantilever, wherein the electronic mount is moveably coupled to the base via an assembly including the first hinge coupled to the riser, which is thereby coupled to the cantilever, which is coupled to the base, providing at least two degrees of freedom of movement of the electronic mount with respect to the base;

wherein, in the stowed state of the tray table, the electronic mount is moveable to position the electronic device above the base, with the screen facing away from the seat back, and in an open position of the tray table, the base is sized to rest on a surface of the tray table, with the electronic mount adapted to position the electronic device above the base, with the screen facing away from the seat back, adjust to multiple viewing angles with respect to the base.

2. The apparatus of claim 1, wherein the cantilever includes two discrete portions disposed on opposite sides of the base.

3. The apparatus of claim 2, wherein the base defines a void sized for passage of a fastener that is configured to fasten the tray table to the airplane seat in the stowed state.

4. The apparatus of claim 3, comprising a hinge between the electronic mount and the base, the hinge configured to rotate the electronic mount with respect to the base.

5. The apparatus of claim 1, wherein the riser is between 2 and 200 millimeters in length.

6. The apparatus of claim 1, comprising a swivel joint coupled between a back of the electronic mount and the riser, the swivel joint configured to allow the electronic mount to swivel with the back disposed in a plane fixed with respect to the base.

7. The apparatus of claim 1, comprising a swivel joint coupled between a back of the electronic mount and the base, the swivel joint configured to allow the electronic mount to swivel with the back disposed in a plane fixed with respect to the base.

8. The apparatus of claim 1, comprising:

wherein the second hinge is configured to hinge the riser around an axis parallel the plane and spaced apart from the plane.

9. The apparatus of claim 8, wherein the first hinge is constrained to rotate around a first hinge axis parallel the axis of the second hinge.

10. The apparatus of claim 1, wherein the cantilever includes two discrete portions disposed on opposite sides of the base and the base defines a void sized for passage of a fastener that is configured to fasten the tray table to the airplane seat in the stowed state, wherein the electronic mount is coupled to the base via the riser and the riser includes two opposing arms disposed on opposite sides of the void.

11. The apparatus of claim 10, wherein the two discrete portions of the cantilever are substantially planar and disposed substantially orthogonal to the base.

12. The apparatus of claim 1, wherein the base is sized and shaped to fit into a recess in a back of the airplane seat.

13. The apparatus of claim 1, wherein the apparatus is foldable into a retracted state in which a height of the apparatus less than or equal to the cantilever length.

14. An apparatus for mounting an electronic device using an airplane seat tray table, comprising:

an electronic mount adapted to removably fasten to the electronic device, the electronic mount including a back to abut an electronic device back to position a screen of the electronic device away from the electronic mount;

a first hinge coupled to the electronic mount;

a riser coupled to the first hinge and extending to a second hinge; and a base coupled to the riser via the second hinge, the base including a portion sized and shaped to fit into a recess in an airplane seat back of the airplane seat, with the second hinge spaced apart from the portion sized and shaped to fit into the recess, and a cantilever portion extending between the portion sized and shaped to fit into a recess in an airplane seat back and the second hinge, the cantilever having a cantilever length at least as long as a thickness of a wall of the recess of the airplane seat, the cantilever to dispose the second hinge cantilevered away from the airplane seat when the airplane seat tray table is in a stowed state with the base disposed in the recess between the tray table and the airplane seat, wherein the back of the electronic mount and the base are parallel to an axis of rotation of the first hinge and an axis of rotation of the second hinge, and wherein, in the stowed state of the tray table, the electronic mount is moveable to position the electronic device above the base, with the screen facing away from the seat back, and in an open position of the tray table, the base is sized to rest on a surface of the tray table, with the electronic mount adapted to position the electronic device above the base, with the screen facing away from the seat back, adjust to multiple viewing angles with respect to the base.

15. The apparatus of claim 14, wherein the base defines at least part of a void sized for passage of a fastener that fastens the tray table to the airplane seat in the stowed state.

16. The apparatus of claim 15, wherein the cantilever includes two members disposed on opposite sides of the void, away from the base, each extending to hinge joints of the second hinge configured to rotate the riser around the axis, the hinge joints disposed on opposite sides of the void.

17. The apparatus of claim 16, wherein the two members of the cantilever are substantially planar and disposed orthogonal to a planar portion of the base.

18. The apparatus of claim 15, wherein the first hinge is a hinge configured to rotate around a first hinge axis parallel the axis of the second hinge.

19. The apparatus of claim 18, comprising a swivel joint coupled between the first hinge and the back of the mount, configured to allow the electronic mount to swivel the back of the mount in a back plane.

20. The apparatus of claim 14, wherein the base as a width that is at least as wide as a maximum side dimension of the electronic device.

21. The apparatus of claim 14, wherein the apparatus is foldable into a retracted state in which a height of the apparatus less than or equal to the cantilever length.

22. An apparatus for removable attachment between an electronic device and a tray table coupled to an airplane seat, comprising:

a base shaped to conform to a plane and sized and shaped to fit between the tray table and the airplane seat, wherein the base defines a void sized for passage of a fastener that is configured to fasten the tray table to the airplane seat in the stowed state;

a cantilever coupled to the base, the cantilever having a cantilever length at least as long as an edge of tray table to extend away from a seat back of the airplane seat when the tray table is in a stowed state with the base disposed between the tray table and the airplane seat back, the cantilever to support the base hanging from the edge of the tray table, wherein the cantilever includes two discrete portions disposed on opposite sides of the base; and an electronic mount coupled moveably coupled to the cantilever to be positioned away from the airplane seat, the electronic mount adapted to removably fasten to an electronic device including a screen, with the screen facing away from the cantilever, wherein, in the stowed state of the tray table, the electronic mount is moveable to position the electronic device above the base, with the screen facing away from the seat back, and in an open position of the tray table, the base is sized to rest on a surface of the tray table, with the electronic mount adapted to position the electronic device above the base, with the screen facing away from the seat back, adjust to multiple viewing angles with respect to the base.

* * * * *

UNITED STATES PATENT AND TRADEMARK OFFICE

CERTIFICATE OF CORRECTION

PATENT NO. : 8,763,976 B1
APPLICATION NO. : 13/353201
DATED : July 1, 2014
INVENTOR(S) : Anton Jachim It is certified that error appears in the above-identified patent and that said Letters Patent is hereby corrected as shown below:

In the Claims:

In column 11, line 60, in Claim 1, after “riser”, delete “on”, therefor

Signed and Sealed this
Seventh Day of October, 2014

Michelle K. Lee

Michelle K. Lee
*Deputy Director of the United States Patent and Trademark Office*